US008569627B1

(12) United States Patent
Salz

(10) Patent No.: US 8,569,627 B1
(45) Date of Patent: Oct. 29, 2013

(54) HIGH SPEED, LOW NOISE, LOW INDUCTANCE TRANSMISSION LINE CABLE

(75) Inventor: David Salz, Plantation, FL (US)

(73) Assignee: Wireworld by David Salz, Inc., Davie, FL (US)

( * ) Notice: Subject to any disclaimer, the term of this patent is extended or adjusted under 35 U.S.C. 154(b) by 257 days.

(21) Appl. No.: 12/870,268

(22) Filed: Aug. 27, 2010

Related U.S. Application Data

(60) Provisional application No. 61/238,877, filed on Sep. 1, 2009.

(51) Int. Cl.
*H01B 7/00* (2006.01)
*H01B 9/02* (2006.01)

(52) U.S. Cl.
USPC ..... 174/113 R; 174/107; 174/102 R; 174/105 R; 174/115; 174/117 F

(58) Field of Classification Search
None
See application file for complete search history.

(56) References Cited

U.S. PATENT DOCUMENTS

| | | | | |
|---|---|---|---|---|
| 761,995 | A | 6/1904 | Pupin | |
| 3,433,687 | A | 3/1969 | Price | |
| 4,096,346 | A | 6/1978 | Stine et al. | |
| 4,208,542 | A | 6/1980 | Endo | |
| 4,439,256 | A | 3/1984 | Meserve | |
| 4,486,252 | A | 12/1984 | Lloyd | |
| 4,564,723 | A * | 1/1986 | Lang | 174/36 |
| 5,220,130 | A | 6/1993 | Walters | |
| 5,393,933 | A | 2/1995 | Goertz | |
| 6,010,788 | A | 1/2000 | Kebabjian et al. | |
| 6,225,563 | B1 | 5/2001 | Poulsen | |
| 6,403,887 | B1 | 6/2002 | Kebabjian et al. | |
| 6,815,611 | B1 | 11/2004 | Gareis | |
| 7,449,639 | B2 | 11/2008 | Nair | |
| 7,462,782 | B2 | 12/2008 | Clark | |
| 7,956,290 | B2 * | 6/2011 | Wang | 174/117 F |
| 7,999,185 | B2 * | 8/2011 | Cases et al. | 174/113 R |
| 2003/0201117 | A1 * | 10/2003 | Sakabe et al. | 174/115 |
| 2008/0173464 | A1 | 7/2008 | Nair | |

* cited by examiner

*Primary Examiner* — Chau Nguyen
*Assistant Examiner* — Dion Ferguson
(74) *Attorney, Agent, or Firm* — Malin Haley DiMaggio & Bowen, P.A.

(57) ABSTRACT

A transmission line cable that utilizes a plurality of substantially flat insulated conductors, each consisting of two or more solid metallic strands laid side by side in a parallel configuration within an extruded insulator. The plurality of insulated conductors are stacked into groups of two or more and may be utilized as signal conductors or shield conductors. Once the insulated conductors are stacked, the stack is twisted together, and either wrapped in a conductive insulator, placed in an extruded non-conductive insulator, or both, creating a cable that is stable, flexible, and has improved transmission characteristics, including reduced attenuation, noise and signal skew.

20 Claims, 5 Drawing Sheets

HIGH SPEED, LOW NOISE, LOW INDUCTANCE TRANSMISSION LINE CABLE

CROSS REFERENCE TO RELATED APPLICATIONS

Priority claimed to provisional application No. 61/238,877, filed on Sep. 1, 2009.

STATEMENT REGARDING FEDERALLY SPONSORED RESEARCH OR DEVELOPMENT

N/A

BACKGROUND OF THE INVENTION

1. Field of the Invention

The present invention relates to cables for transmitting electrical signals or power. The signals may be either analog or digital in nature. In particular, the present invention relates to extruded cables wherein the conductors consist of groups of round strands laid in parallel to form flat conductors with high flexibility and improved transmission characteristics, including reduced attenuation, noise and signal skew.

2. Description of the Related Art

The concept of increasing the mutual inductance of a cable to reduce its attenuation was originally disclosed in 1904 by Michael Pupin's U.S. Pat. No. 761,995 for the invention of the telephone loading coil. Essentially, the coils function is to increase the mutual inductance of the two conductors to reduce the inductive reactance of the circuit, thereby minimizing the frequency selective attenuation that had previously made long distance telephone communications unintelligible. The effectiveness of that invention, commonly referred to as the Pupin Coil, made it the worldwide standard for telephone systems over the past century.

In the many years since the development of the telephone loading coil, the bandwidth and dynamic range of audio systems have increased dramatically. To meet those demands, a number of cable designs have been developed to provide the benefits of both low inductance and low resistance without the complexity, cost and functional limitations of external loading coils. The challenge of those designs is to overcome the inherent tendency of thick cylindrical conductors to increase inductive reactance while creating additional frequency selective loss due to 'skin effect'. To provide low loss from both inductance and resistance, a cable must have relatively thin conductors with a large cross-sectional area, and the distance between the two polarities must be minimized. While previous low-Inductance cable designs have provided some improvements over conventional cables, none have proven to be both highly effective and practical to implement in a wide range of applications. Therefore, the need exists for cables that can minimize both inductive and resistive losses, while maintaining the practicality of conventional cable designs.

The audio cable disclosed by Poulsen in U.S. Pat. No. 6,225,563 provides the signal transmission advantages of low inductance, but its applications are somewhat limited by its use of extremely thin ribbon conductors, which are fragile and require the use of special handling and termination procedures.

The low inductance loudspeaker cable disclosed by Goertz in U.S. Pat. No. 5,393,933, has one embodiment that utilizes solid flat conductors which are inherently stiff and require the use of specialized parts and techniques for termination and handling. Another embodiment disclosed in by Goertz utilizes stranded conductors, but it fails to provide any effective means for stabilizing the conductors when the cable is flexed.

The loudspeaker cable disclosed by Endo in U.S. Pat. No. 4,208,542 provides the benefits of low inductance through the use of a complex braided construction consisting of numerous enamel coated strands. The termination procedure for the Endo cable is very unusual and requires the use of specialized tools and instructions.

Nonetheless, there still remains a need for a cable that provides the signal transmission advantages found in the Paulsen, Goertz, and Endo cable designs, while also providing additional benefits such as lower noise and the versatility of conventional cable designs and extending those benefits to a wider range of applications.

Cables also degrade the fidelity of signal transmission by introducing noise. In addition to externally induced noise, or electromagnetic interference ("EMI"), cables contaminate electrical signals with triboelectric noise, which is generated by movement, intermittent contact and localized charge/discharge effects between the conductors and insulation. Several methods for minimizing triboelectric noise are disclosed in by Price in U.S. Pat. No. 3,433,687 and Lloyd in U.S. Pat. No. 4,486,252. The cable structure disclosed by Price utilizes semiconducting compounds and increased contact area between the conductor and insulation materials to minimize noise. The cable structure taught by Lloyd takes the Price concept a step further by imbedding the shield conductor in a conductive plastic compound. What is still needed, however, are cables that combine the advantages of reduced triboelectric noise with the improved transmission capabilities afforded by reducing inductance, while preserving the simplicity and low cost of conventional cable designs. The proliferation of high definition digital video and audio applications such as the HDMI (High Definition Multimedia Interface) is continuously increasing the demand for high-speed data cables with increased bandwidth and signal fidelity. In addition to the signal attenuation and triboelectric noise problems mentioned above, the performance of high-speed digital signal cables can be limited by several additional factors, including impedance uniformity, crosstalk, and skew. Therefore, the need exists for cables that can minimize those limitations to deliver data at higher speeds over longer lengths and with greater consistency.

The connection standards for the most common high-speed data applications utilize differential pairs, in which the data is represented by polarity reversals in the voltage applied to the cable by the sending device. The polarity reversals create signals in the form of high-frequency square waves. As the signal current is conducted through a cable, the signal waveforms are attenuated and distorted by the loss factors of the cable. The degree of waveform attenuation and distortion introduced by a digital signal cable has a direct influence on the number of data errors produced by the receiving device. Therefore, a cable design that minimizes all of the known loss factors would reduce data errors while allowing higher transmission speeds and longer cable lengths to be utilized. The primary advantage of utilizing differential connections is their superior ability to reject noise from external sources. Since the two sides of a differential signal are equal and opposite, noise picked up by the pair of conductors will tend to be eliminated by phase cancellation. Despite that distinct advantage over single-conductor cables, differential cables are nonetheless subject to a variety of limitations that can distort and contaminate both analog and digital signals.

Digital signal transmission is highly dependent on the accurate timing of the waveforms appearing at the receiving device. If one side of a differential signal arrives significantly ahead of the other side, the resulting waveform will be distorted. Timing errors in differential digital connections must be minimized to provide reliable and accurate signal transmission. The specific delay time between the signals received from the two conductors of a differential pair, or between two corresponding pairs, is called skew. The signal skew produced by a cable increases with the length of the cable. Skew can be caused by impedance variations or differences in the length of the conductors or conductor pairs. In high-speed data cables, minimizing signal skew is necessary to prevent the destructive digital timing errors known as jitter.

The measured loss of signal amplitude in a cable is called attenuation. Reducing cable attenuation is desirable, because it allows a cable to function properly over longer distances. The attenuation of a cable is primarily caused by resistance, inductance and capacitance, but variations in the loading effect of characteristic impedance along the length of a cable can also increase attenuation. Furthermore, a net difference in the impedance of the two conductors of a differential pair can also cause a skew error. Since those impedance variations are caused by inconsistent positioning of the conductors in relation to the shield, it is desirable for the conductors to maintain consistent positions with respect to one another and with respect to the cable's shield. It is also desirable for a cable to withstand the flexing and physical stress of long-term use and to maintain stable transmission characteristics as the cable is flexed.

The high-speed data transmission cable design disclosed by Kebabjian et al. in U.S. Pat. No. 6,403,887 provides a method of minimizing both impedance and length variations within a differential pair of conductors, in addition to stabilizing the conductor positions and impedance variations as the cable is flexed. While the design taught by Kebabjian makes progress in addressing these issues, cable structure designs that can further reduce noise, inductive loss and attenuation can provide higher performance in contemporary high-speed data applications.

The high-speed data transmission cable designs disclosed by Nair in U.S. Patent Application Publication Number 2008/0173464 utilize flat conductors each consisting of a single flattened wire in order to minimize loss due to 'skin effect'. The single flattened wire design, however, not only adds specialized procedures to the manufacturing process, it creates a cable structure that is inherent more stiff, which would be a distinct disadvantage in speaker cable applications where flexibility and ease of termination are required. Furthermore, the shielded version of the Nair invention does not include any provision for a low loss ground path for the shields, which is a basic requirement for high speed, low loss data cables. The use of a conventional braided or served shield over each of the balanced pairs would negate most of the advantages of the design because of the inductive nature of those shields. Consequently, there remains a need for a cable design that can minimize loss due to skin effect, while still using standard round strands, so not to require additional manufacturing and so that the flexibility of the cable is preserved. Additionally, it would be desirable for the cable design to utilize drain wires and shield with conductive characteristics that match or even exceed those of the signal pair, which is common practice in conventional balanced pair shielded data cables.

Flattened conducting wires are also disclosed by Nair in U.S. Pat. No. 7,449,639, where the flattened conducting wires coated with insulation are bonded to one-another, with rectangular cross-sections and flat surfaces. Separate flat wire pairs are geometrically oriented within outer rectangular shell, and there is a separate core structure. In U.S. Pat. No. 7,462,782, Clark teaches of a number of different insulated conductors optimizing geometric shapes and forms for communication cables to enhance performance. There is no teaching in Nair or Clark, however, to use standard round strands that do not require additional manufacturing and that retain flexibility in the cable to create wires that are flat, rectangular or any other geometric shape.

BRIEF SUMMARY OF THE INVENTION

The present invention relates to transmission cable designs that utilize novel conductors consisting of two or more solid metallic strands laid side by side in a flat parallel configuration within an extruded insulator. Groups of these flat conductors are stacked and twisted together to form structures that are both stable and flexible. The stacked configuration increases the mutual inductance between the signal conductor (s) and the shield conductor(s), thus reducing the signal attenuation caused by inductive reactance. The shield conductors may be covered with conductive plastic to minimize noise generation while providing an electrical connection to the shield.

It is an objective of the present invention to provide a high-speed data transmission cable with reduced skew, attenuation and noise, thus reducing the data errors of the transmission system.

It is another objective of the present invention to provide high-speed data transmission cables that function properly at longer lengths than conventional cables.

It is another objective of the present invention to provide analog audio cables with improved transmission characteristics, including greater impedance uniformity, reduced attenuation and lower noise.

It is another objective of the present invention to provide cables with improved transmission characteristics that can be manufactured efficiently while maintaining a high degree of consistency.

It is another objective of the present invention to provide cables with improved transmission characteristics that can be utilized as direct replacements for conventional cables without the need for special connectors, tools or procedures.

These and other objects and advantages of the present invention will become apparent through the drawings and the accompanying description set forth hereinafter.

DETAILED DESCRIPTION OF THE INVENTION

Transmission cables, built in accordance with the present invention, will now be described with initial reference to FIGS. 1-9. The conductor strands and wires in each of these descriptions are copper. In other embodiments, however, the conductor strands and wires may also consist of various grades and combinations of copper and silver.

Figure 1:
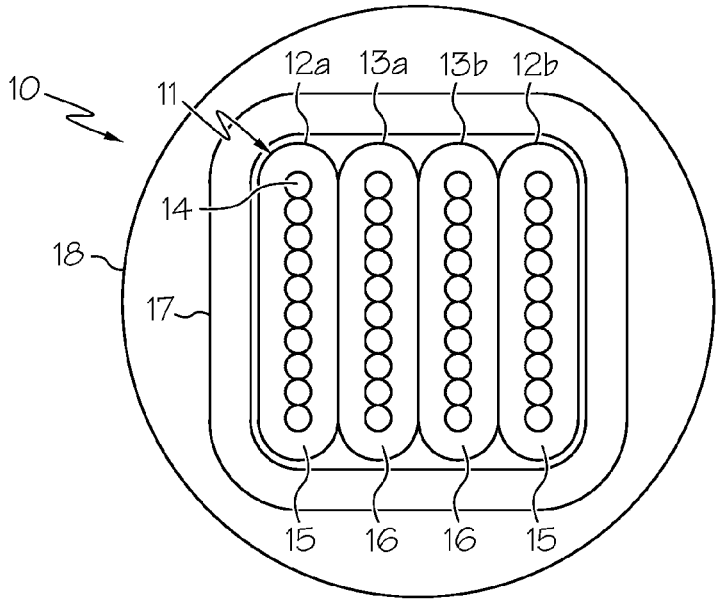
FIG. 1 is cross-sectional view of an embodiment of the inventive four-conductor shielded audio cable architecture.

Referring now to FIG. 1, the design of an inventive four (4) conductor transmission cable 10 is defined by four substantially flat conductors each consisting of ten (10) solid metallic strands laid side by side in a flat parallel configuration within an extruded insulator. The four conductors are stacked together to form a rectangular profile 11. These conductors include shield conductors embodied by a first outer conductor 12*a* and a second outer conductor 12*b*, and signal conductors embodied by a first inner conductor 13*a* and a second inner conductor 13*b*. The first outer conductor 12*a* and the second outer conductor 12*b* each consist of ten (10) copper strands 14 arranged side by side in a flat parallel configuration within a carbon-loaded conductive polyethylene ("PE") extrusion 15. In other embodiments, the extrusion 15 can be of other conductive plastic materials. The first inner conductor 13*a* and the second inner conductor 13*b* each consist of ten (10) copper strands 14 arranged side by side in a flat parallel configuration within an extruded polyethylene ("PE") insulator 16. In other embodiments, the insulator 16 can be made with other standard, non-conductive materials. The first inner conductor 13*a* and the second inner conductor 13*b* may be used as a balanced pair or combined together as a single conductor. To create a uniform and stable structure, the rectangular profile 11 comprising the stacked first outer conductor 12*a*, first inner conductor 13*a*, second inner conductor 13*b*, and second outer conductor 12*b* is twisted into a 30 millimeter ("mm") long spiral configuration.

In all four conductors, each individual copper strand is 0.16 mm in diameter, creating a substantially flat conductor with the dimensions of 0.16 mm by 1.6 mm when arranged in accordance with this embodiment. The four extruded insulators which house the conductors have dimensions of 0.7 mm by 2.3 mm.

The rectangular profile 11 is surrounded by a flexible extrusion 17, which is a tight tubular extrusion of highly conductive Polyvinyl chloride ("PVC") with a 0.8 mm wall thickness. This flexible extrusion 17 is surrounded by an outer jacket 18, which is a round PVC extrusion with a 7 mm diameter. In other embodiments, the outer jacket 18 can be other common extruded insulation materials. In this design, the conductor lengths are identical and their relative positions are extremely stable, providing very low skew. Also, the parallel and closely coupled relationship of the conductors provides superior EMI rejection, while minimizing inductive reactance, which reduces signal attenuation. Furthermore, the conductive extrusions reduce triboelectric noise to improve signal quality.

Figure 2:
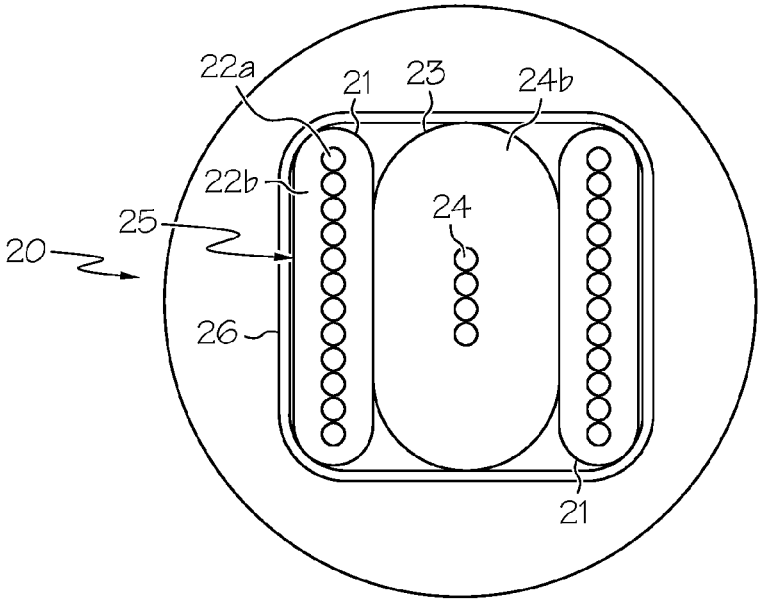
FIG. 2 is cross-sectional view of an embodiment of the 75-ohm cable architecture.

Referring now to FIG. 2, the design of an inventive 75 ohm three (3) conductor transmission cable 20 is defined by three (3) stacked flat conductors, with each conductor consisting of several solid metallic strands laid side by side in a flat parallel configuration within an extrusion. With regard to the pair of shield outer conductors 21, each individual consists of twelve (12) 0.18 mm diameter copper strands 22*a* covered with a flat conductive PE extrusion 22*b* that measures 0.8 mm by 3.5 mm. The signal inner conductor 23 consists of four (4) 0.18 mm copper strands 24*a* insulated with a larger oval shaped low-density polyethylene ("LDPE") insulator 24*b* measuring 2 mm by 3.5 mm. Stacked, the three conductors are twisted together to form a rectangular profile 25, with a 35 mm twist length. The rectangular profile 25 is spiral wrapped with a metalized copper/Mylar foil tape 26 having its copper side of the shield facing inside, and then enclosed into a round PVC extrusion 27 with a 7 mm diameter. This configuration has been optimized to produce a characteristic impedance of 75-ohms. The inner conductor 23 provides 20% lower self-inductance than a single conductor of the same effective wire gauge. The two outer conductors 21 also utilize parallel conductor strands to provide substantially lower self-inductance than conventional braided or served shields. The reduced self-inductance afforded by this design has proven to be helpful in reducing signal skew and attenuation, thereby minimizing data errors due to jitter.

Figure 3:
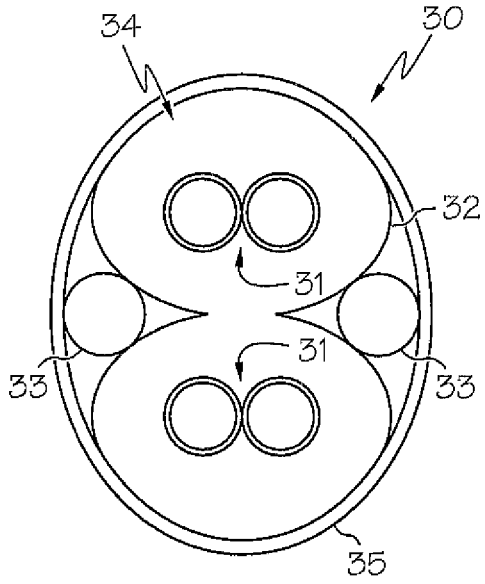
FIG. 3 is cross-sectional view of an embodiment of the inventive 23 American Wire Gauge ("AWG") 100-ohm balanced pair cable architecture.
Figure 4:
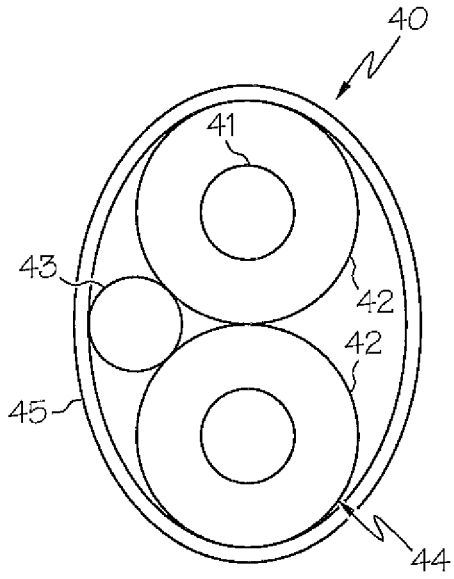
FIG. 4 is cross-sectional view of an embodiment of a conventional 24 AWG 100-ohm balanced pair cable architecture.

Referring now to FIGS. 3 and 4, the designs of an inventive 23 American Wire Gauge ("AWG") 100 ohm balanced conductor pair transmission cable 30, built in accordance with the present invention, and a conventional 24AWG 100 ohm balanced conductor pair transmission cable 40 are shown. While the inventive 23AWG cable 30 and the conventional 24AWG cable 40 both function as 3-conductor shielded balanced pairs, the inventive 23AWG cable 30 utilizes a balanced pair of dual strand conductors 31 covered within a figure-of-eight shaped high-density polyethylene ("HDPE") foam extrusion 32 and two (2) solid drain wires 33. Each copper strand in the pair of dual strand conductors 31 is 26AWG, which is 0.4 mm in diameter. To adequately separate the balanced conductor pairs, the figure-of-eight shape of the HDPE extrusion 32 consists of gas injected HDPE foam that is defined in appearance by two (2) stacked ovals, each containing a conductor pair in its center, where each oval has a large diameter of 2.0 mm and a small diameter of 1.4 mm. As a result, the HDPE extrusion 32 is a structure that is 2.8 mm at its point of greatest length by 2.0 mm at its two points of greatest width, with those two points being the large diameter of the ovals with comprise it. The copper drain wires 33, located on either side of the HDPE extrusion 32, each measure 0.4 mm in diameter. The extruded conductors 34 and drain wires 33 are twisted together with a 26 mm twist length and spiral wrapped in a foil shield 35 that is a copper/Mylar foil tape with the copper side on the inside.

Conversely, the conventional 24AWG cable 40 utilizes a balanced pair single strand conductors 41 covered within two round extrusions 42 and one (1) solid drain wire 43. Each strand in the balanced pair 41 is 0.51 mm in diameter and the drain wire 43 is also 0.51 mm. The covered conductors 44 and the drain wire 43 are twisted together and spiral wrapped in a foil shield 45 that is an aluminum/Mylar foil tape with the aluminum side on the inside.

In contrast to the conventional 24AWG cable 40, the inventive 23AWG cable 30 configuration is especially useful as it provides substantially lower attenuation than the conventional 24AWG cable 40, while taking up the same amount of space within a cable construction, such as HDMI, where four balanced signal pairs are used. The conventional 24AWG cable 40, containing a single 0.51 mm diameter strand 41 per conductor and a single 0.51 mm drain wire 43, has a twisted diameter of 2.9 mm and a balanced impedance of 100-ohms. The inventive 23AWG cable 30, containing dual 0.4 mm conductors 31 and two symmetrically placed 0.4 mm drain wires 33, also has a twisted diameter of 2.9 mm and a balanced impedance of 100-ohms. The use of dual 0.4 mm conductor strands 31 in place of a single 0.51 mm conductor strand 41 provides a 20% reduction in resistance and approximately 30% lower self inductance, thereby providing substantially lower attenuation than the conventional design. Furthermore, the symmetrical pair of drain wires 33 provides improved impedance uniformity, as variations in the centering of the conductor strands will have less effect on the degree of coupling between the signal and shield conductors. The inventive 23AWG cable 30 also provides greater consistency of the air spaces within the foil shield 35 and it also stabilizes the drain wire 33 positions, providing an additional improvement in impedance uniformity and lower triboelectric noise. Also, the 0.4 mm strands 31 provide higher flexibility and greater flex life than the 0.51 mm strands 41. The compactness of this embodiment is very advantageous in HDMI applications, where high-bandwidth and low attenuation is essential, and the cable diameter is limited by connector dimensions and flexibility requirements.

Figure 5:
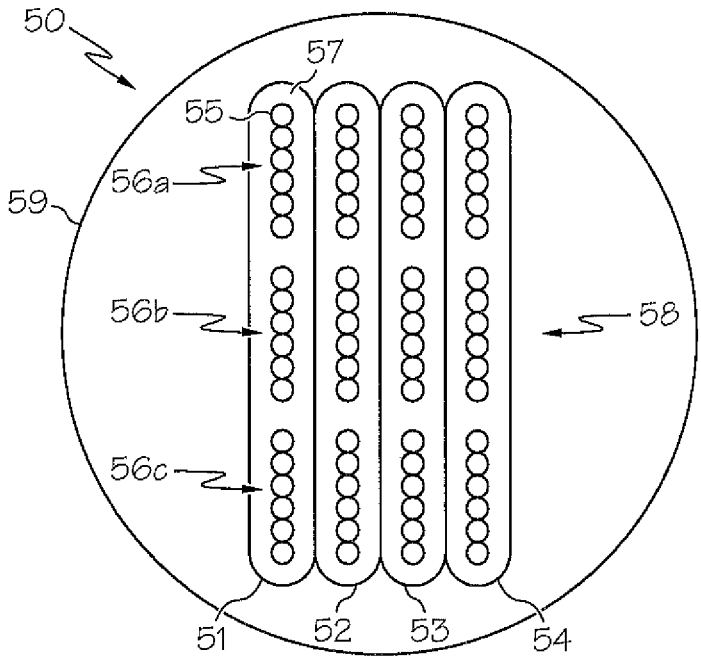
FIG. 5 is cross-sectional view of an embodiment of the inventive 4×14AWG speaker cable architecture.
Figure 6:
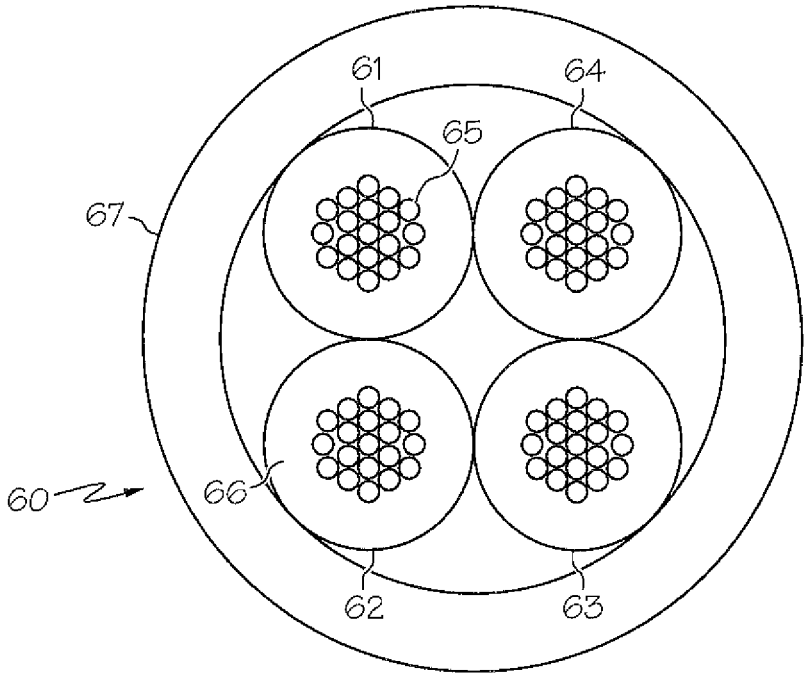
FIG. 6 is cross-sectional view of an embodiment of a conventional 4×14 AWG speaker cable architecture.

Referring now to FIGS. 5 and 6, the designs of an inventive 4×14AWG speaker cable 50, built in accordance with the present invention, and a conventional 4×14AWG speaker cable 60 are shown. The inventive 4×14AWG cable 50 utilizes four (4) flat extruded conductors stacked together, with a first outside conductor 51, a first inside conductor 52, a second inside conductor 53, and a second outside conductor 54. The first outside conductor 51, first inside conductor 52, second inside conductor 53, and second outside conductor 54 each have an identical structure, where each one is made up of eighteen (18) strands 55 of 0.4 mm copper arranged sequentially, with six (6) strands in a first strand group 56*a*, with six (6) strands in a second strand group 56*b*, and with six (6) strands in a third strand group 56*c*. In addition, each conductor is covered with a HDPE extrusion 57 measuring 1.25 mm by 10 mm. The extruded conductors are stacked and strands arranged so that each strand group in a conductor is parallel to the corresponding numbered strand group of every other conductor (i.e. the first strand group 56*a* of the first outside conductor 51 is parallel to the first strand group 56*a* of the first inside conductor 52, second inside conductor 53, and second outside conductor 54). The four stacked extruded conductors create a rectangular profile 58 that is twisted with a twist length of 60 mm and enclosed within a round PVC extrusion jacket 59 having a 13 mm diameter.

The conventional 4×14AWG speaker cable 60 utilizes four (4) round extruded conductors twisted together, with a first conductor 61, a second conductor 62, a third conductor 63, and a fourth conductor 64. The first conductor 61, second conductor 62, third conductor 63, and fourth conductor 64 each have an identical structure, where each one is made up of a plurality of copper strands 65 bundled and twisted together inside an extrusion of HDPE 66. The bundled extruded conductors have a twist length that measure 60 mm and are enclosed within a round PVC extrusion jacket 67 having a 13 mm diameter.

By utilizing flat conductors instead of round conductors, the inventive 4×14AWG speaker cable 50 is able to reduce the high inductive reactance and skin effect loss that is inherent to the conventional 4×14AWG speaker cable 60. These improvements are accomplished with standard manufacturing techniques and improved efficiency, since the manufacturing process of the inventive design eliminates the strand bundling step required to produce the conventional cable.

Figure 7:
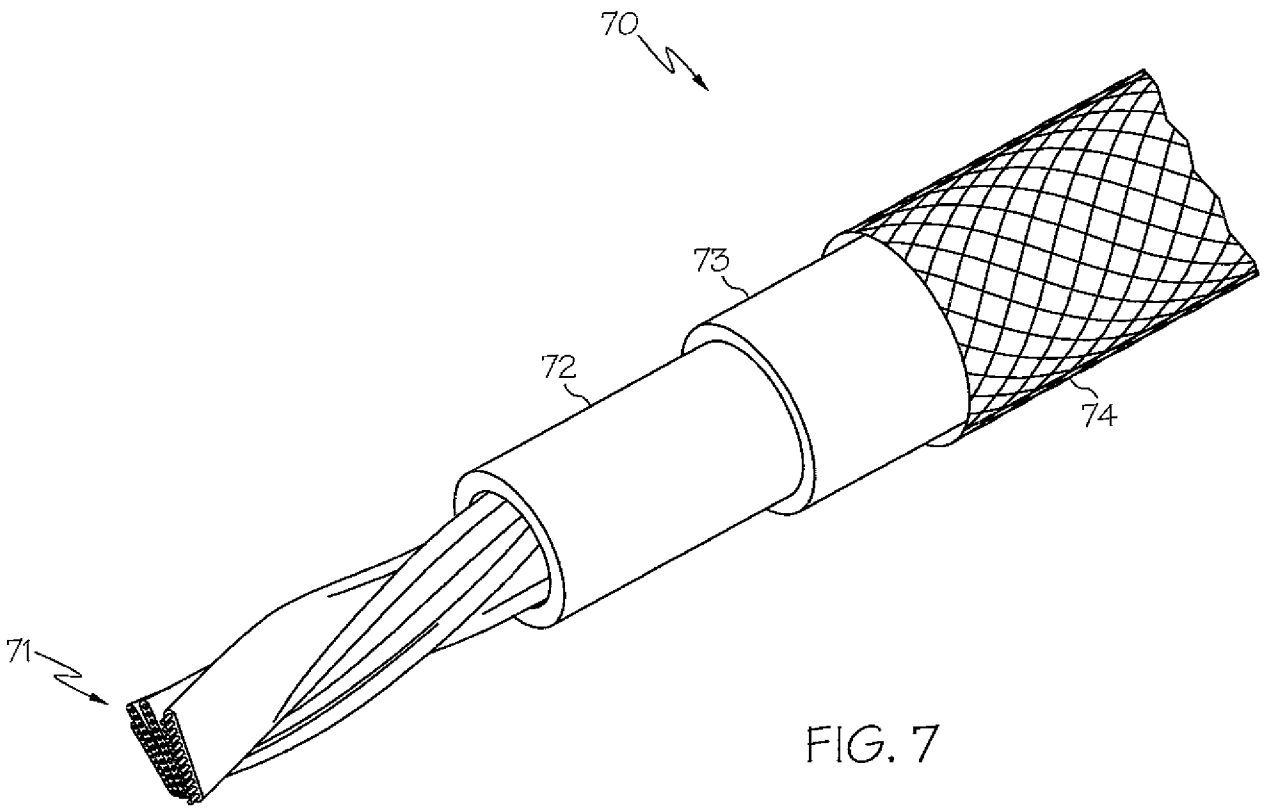
FIG. 7 is perspective view of the internal structure of a cable consisting of four (4) flat insulated conductors.

Referring now to FIG. 7, the internal structure of a cable built in accordance with the present invention is shown. An inventive cable 70 is shown consisting of four (4) insulated conductors 71 twisted together inside an inner extrusion 72, which is contained within a round extruded outer jacket 73. The outer jacket 73 is surrounded by a nylon braiding 74.

Figure 8:
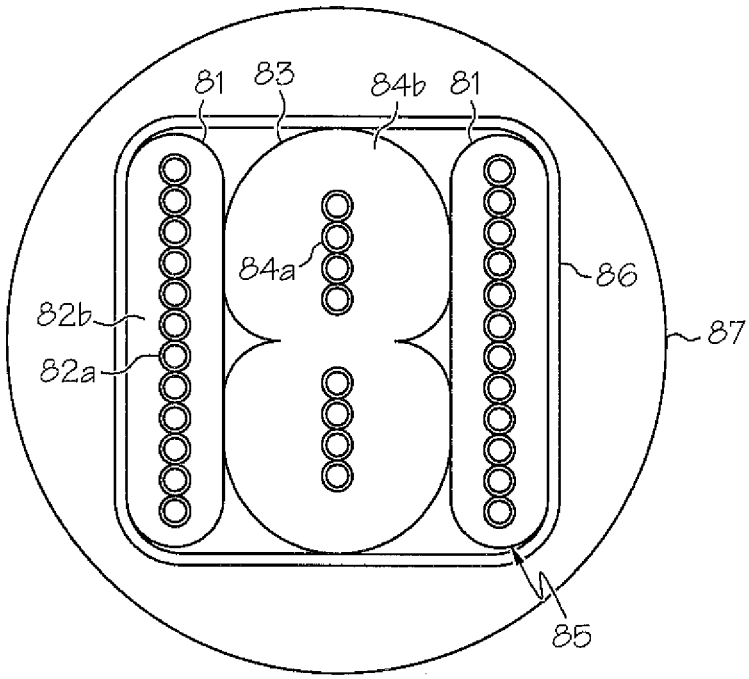
FIG. 8 is cross-sectional view of an embodiment of a 110 ohm balanced pair cable architecture.

Referring now to FIG. 8, an inventive 110 ohm balanced pair embodiment of the 75 ohm three (3) conductor transmission cable 20 is shown. The inventive 110 ohm four (4) conductor transmission cables 80 is defined by three flat conductors, with each individual conductor consisting of several solid metallic strands in a flat parallel configuration within a flexible extrusion. With regard to the two shield outer conductors 81, each individual conductor consists of twelve (12) 0.18 mm diameter copper strands 82*a* covered with a flat conductive PE extrusion 82*b* that measures 0.8 mm by 3.5 mm. The signal inner conductor 83 consists of eight (8) 0.18 mm copper strands 84*a* positioned in two distinct contiguous rows and insulated with an oval shaped low-density polyethylene ("LDPE") insulator 84*b* measuring 2 min by 4 mm. The inner conductor 83 rows are aligned linearly within a single FIGURE-of-eight shaped extrusion 84*b*. The inner conductor 83 is then stacked with the two outer conductors 81, so that the outer conductors 81 flank the inner conductor 83, forming a rectangular profile 85 that is twisted with a 35 mm twist length. The rectangular profile 85 is spiral wrapped with a metalized copper/Mylar foil tape 86 having its copper side of the shield facing inside, and then enclosed into a round PVC extrusion 87 with a 7 mm diameter. This configuration, which is optimized to produce a balanced characteristic impedance of 110-ohms, reduces the capacitive coupling between the two conductors, which is considered a parasitic loss unrelated to any necessary electrical characteristics of a balanced signal cable.

Figure 9:
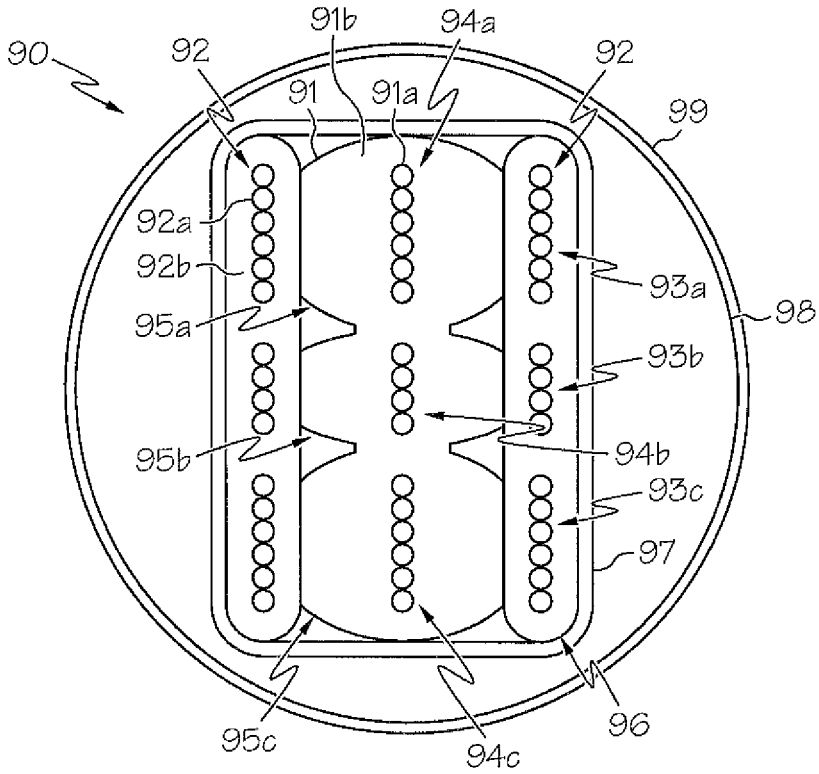
FIG. 9 is cross-sectional view of an embodiment of a 75 ohm/110 ohm balanced pair composite cable architecture.

Referring now to FIG. 9, an inventive 75 ohm/110 ohm composite transmission cable 90, which allows different impedances to be matched within a single cable, is shown. The composite cable 90 utilizes three (3) flat extruded conductors stacked together, with a signal inner conductor 91 stacked between a pair of shield outside conductors 92. The two outside conductors 92 each have an identical structure, where each one is made up of sixteen (16) strands 92*a* of 0.22 mm copper arranged sequentially in three distinct sections, with six (6) strands in a first outer strand group 93*a*, four (4) strands in a second outer strand group 93*b*, and six (6) strands in a third outer strand group 93*c*. The strands 92*a* of the outer conductor 92 are covered in a conductive PE, measuring 0.8 mm by 5 mm. The inner conductor 91 is also made up of sixteen (16) strands 91*a* of 0.22 mm copper. Moreover, the strands 91*a* of the inner conductor 91 are similarly arranged sequentially in three distinct sections, with six (6) strands in a first inner strand group 94*a*, four (4) strands in a second inner strand group 94*b*, and six (6) strands in a third inner strand group 94*c*. The strands 91*a* of the inner conductor 91 are insulated in LDPE by strand group, so that the first inner strand group 94*a*, second inner strand group 94*b*, and third inner strand group 94*c* are enclosed in a first oval shaped insulator partition 95*a*, a second oval shaped insulator partition 95*b*, and a third oval shaped insulator partition 95*c*, respectively. The first oval shaped insulator partition 105*a*, second oval shaped insulator partition 95*b*, and third oval shaped insulator partition 95*e* are aligned linearly, with the second oval shaped insulator partition 95*c* between the first oval shaped insulator partition 95*a* and third oval shaped insulator partition 95*c*, and adjoined about their small diameter. The resulting structure of the inner conductor 91 is a 3 mm by 5.7 mm at its widest and 1.3 mm by 5.7 mm at its most narrow, and has a black stripe on one edge.

The three conductors are stacked and strands arranged so that each strand group in a conductor is parallel to the corresponding numbered strand group of every other conductor (i.e. the first outer strand group 93*a* parallels the first inner strand group 94*a*). The three stacked conductors create a rectangular profile 96 that is twisted with a twist length of 45 mm and spiral wrapped in a copper/Mylar foil tape 97, with the copper side facing the conductors. The foil shield is enclosed in an extruded PVC jacket 98 with an 8 mm diameter. The jacket is then covered with a nylon braid 99.

When the inventive composite cable 90 is used as a 75 ohm cable, only the second inner strand group 94*b* is used. Conversely, when the inventive composite cable 90 is used as a 110 ohm balanced pair cable, the first inner strand group 94*a* and third inner strand group 94*c* of the inner conductor 91 are used. In either configuration, the first outer strand group 93*a*, the second outer strand group 93*b*, and the third outer strand group 93*c* are used as shield strands.

The present invention is not limited to the specific embodiments described. Many different embodiments exist without departing significantly from the scope or the spirit of the present invention. The described embodiments thus serve as examples of the present invention and are not restrictive of the scope of the invention.

What is claimed is:

1. A transmission line cable comprising:

two or more solid metallic strands;

a plurality of discrete aggregate wires, wherein each said aggregate wire is comprised of two or more of said strands arranged side by side in direct contact on at least one plane, forming at least one contiguous row on each plane, within a single flexible extrusion; and at least two of the aggregate wires being stacked together in a twisted stack structure, wherein said twisted stack structure is defined by the lengthwise planes created by each aggregate wire's strands are oriented in parallel with and facing the strands of the other aggregate wires and the aggregate wires in the stack being twisted into a spiral formation.

2. The transmission line cable of claim 1, additionally comprising at least one layer of a metallic shield that surrounds the twisted stack structure along its length.

3. The transmission line cable of claim 1, additionally comprising an extruded cable jacket that surrounds the twisted stack structure along its length.

4. The transmission line cable of claim 1, wherein:

the cable has a first aggregate wire, a second aggregate wire, a third aggregate wire, and a fourth aggregate wire;

said first aggregate wire and said fourth aggregate wire each being within a first conductive extrusion;

said second aggregate wire and said third aggregate wire each being within a wire insulation extrusion;

said first aggregate wire, second aggregate wire, third aggregate wire, and fourth aggregate wire are oriented in said twisted stack structure with the second aggregate wire and the third aggregate wire being in between the first aggregate wire and the fourth aggregate wire; and said twisted stack structure being surrounded along its length by a second conductive extrusion.

5. The transmission line cable of claim 4, wherein:

said first aggregate wire, second aggregate wire, third aggregate wire, and fourth aggregate wire each have strands on only one plane; and the second conductive extrusion is surrounded along its length by an extruded cable jacket.

6. The transmission line cable of claim 1, wherein:

the cable has a first aggregate wire, a second aggregate wire, and a third aggregate wire;

said first aggregate wire and said third aggregate wire each being within a conductive extrusion;

said second aggregate wire is within an wire insulator extrusion;

said first aggregate wire, second aggregate wire, and third aggregate wire are oriented in said twisted stack structure with the second aggregate wire being in between the first aggregate wire and the third aggregate wire; and said twisted stack structure being surrounded along its length by at least one layer of a metallic shield.

7. The transmission line cable of claim 6, wherein said metallic shield surrounding the twisted stack being surrounded along its length by an extruded cable jacket.

8. The transmission line cable of claim 6, wherein said first aggregate wire, second aggregate wire, and third aggregate wire each have strands on only one plane.

9. The transmission line cable of claim 6, wherein:

said first aggregate wire and said third aggregate wire each have one distinct contiguous row of strands; and said second aggregate wire has two distinct contiguous rows of strands.

10. The transmission line cable of claim 6, wherein said first aggregate wire, second aggregate wire, and third aggregate wire each have a plurality of distinct contiguous rows of strands.

11. The transmission line cable of claim 10, wherein:

said first aggregate wire, second aggregate wire, and third aggregate wire each have three of distinct contiguous rows of strands; and each distinct row of strands in said first aggregate wire second aggregate wire, and third aggregate wire is aligned with another corresponding distinct row of strands in the other aggregate wires.

12. The transmission line cable of claim 1, wherein:

the cable has a first aggregate wire;

said first aggregate wire having a wire insulator extrusion, said wire insulator extrusion shaped in a FIG. 8 configuration;

said first aggregate wire having at least four total strands evenly distributed on two distinct planes and arranged within said wire insulator extrusion in opposing sections of the FIG. 8 configuration, wherein the lengthwise planes created by the rows of strands are oriented in parallel and facing each other;

said cable additionally comprises two drain wires;

said drain wires positioned outside of and on opposing sides of said wire insulator extrusion; and the first aggregate wire and the drain wires being twisted lengthwise into a spiral formation.

13. The transmission line cable of claim 12, wherein said twisted first aggregate wire and the drain wires are surrounded lengthwise by a conductive metalized foil tape.

14. The transmission line cable of claim 1, wherein:

the cable has a first aggregate wire, a second aggregate wire, a third aggregate wire, and a fourth aggregate wire;

said first aggregate wire, second aggregate wire, third aggregate wire, and fourth aggregate wire each being within a wire insulator extrusion; and said first aggregate wire, second aggregate wire, third aggregate wire, and fourth aggregate wire are oriented in said twisted stack structure with the second aggregate wire and the third aggregate wire are in between the first aggregate wire and the fourth aggregate wire.

15. The transmission line cable of claim 14, wherein said twisted stack structure is surrounded along its length by an extruded cable jacket.

16. A transmission line cable comprising:

four solid metallic strands, arranged as a first wire pair and a second wire pair;

said first wire pair and second wire pair each having two strands arranged side by side in direct contact on one plane, forming in one contiguous row; o a single wire insulator extrusion, said wire insulator extrusion being shaped in a FIG. 8 configuration said first wire pair running parallel to second wire pair, with the first wire pair and second wire pair being on two distinct planes;

said first wire pair and second wire pair being within said arranged within said wire insulator extrusion in opposing sections of the FIG. 8 configuration, wherein the two lengthwise planes created by the rows of strands are oriented in parallel and facing each other;

two drain wires, where said drain wires are positioned outside of and on opposing sides of said wire insulator extrusion; and said wire insulator extrusion and drain wires being twisted together into a spiral formation and surrounded lengthwise by a conductive metalized foil tape.

17. The transmission line cable of claim 16, wherein the two drain wires are positioned symmetrically to each other in said wire insulator extrusion and on a plane distinct from either lengthwise planes created by the rows of strands of the first wire pair and second wire pair.

18. The transmission line cable of claim 17, wherein the two drain wires are positioned on a plane in between the two lengthwise planes created by the rows of strands of the first wire pair and second wire pair.

19. A transmission line cable comprising:

four solid metallic strands, arranged as a discrete first wire pair and a discrete second wire pair;

said first wire pair and second wire pair each having two strands arranged side by side in direct contact on one plane, forming in one contiguous row;

said first wire pair running parallel to second wire pair, with the first wire pair and second wire pair being on two distinct planes such that the two lengthwise planes created by the rows of strands are oriented in parallel and facing each other;

said first wire pair and second wire pair being arranged within at least one wire insulator extrusion;

two drain wires, where said drain wires are positioned outside of and on opposing sides of said at least one wire insulator extrusion on a plane distinct from the two lengthwise planes created by the rows of strands of the first wire pair and second wire pair; and said at least one wire insulator extrusion and drain wires being twisted together into a spiral formation and surrounded lengthwise by a conductive metalized foil tape.

20. The transmission line cable of claim 19, wherein the two drain wires are positioned on a plane in between the two lengthwise planes created by the rows of strands of the first wire pair and second wire pair.

* * * * *